US006857384B1

(12) United States Patent
Connor

(10) Patent No.: US 6,857,384 B1
(45) Date of Patent: Feb. 22, 2005

(54) GAS TANK SHADE SYSTEM

(76) Inventor: Paul-William Connor, 276 Maple Ave., Palm Harbor, FL (US) 34684

( * ) Notice: Subject to any disclaimer, the term of this patent is extended or adjusted under 35 U.S.C. 154(b) by 0 days.

(21) Appl. No.: 10/700,154

(22) Filed: Nov. 3, 2003

(51) Int. Cl.[7] ..... B63B 17/00
(52) U.S. Cl. ..... 114/361; 150/157; 150/166
(58) Field of Search ..... 114/361; 150/157, 150/166

(56) References Cited

U.S. PATENT DOCUMENTS 4,706,599 A * 11/1987 Johnson ..... 114/361
4,998,496 A * 3/1991 Shaw, III ..... 114/222
5,673,646 A * 10/1997 Knudson ..... 114/343
5,698,288 A * 12/1997 Barnes ..... 428/76

* cited by examiner

*Primary Examiner*—Jesus D. Sotelo
(74) *Attorney, Agent, or Firm*—Edward P. Dutkiewicz

(57) ABSTRACT

A first strip of a fastener is securable to the vertical rear wall in a horizontal orientation at an elevation above the container and parallel with a horizontal platform. A shading member fabricated of a flexible material is in a rectangular configuration. The shading member has an upper horizontal edge, a parallel lower horizontal edge, and parallel side edges. The shading member has a second strip of a fastener. The second strip of fastener is adapted to separably coact with the first fastener.

1 Claim, 2 Drawing Sheets

FIG 3
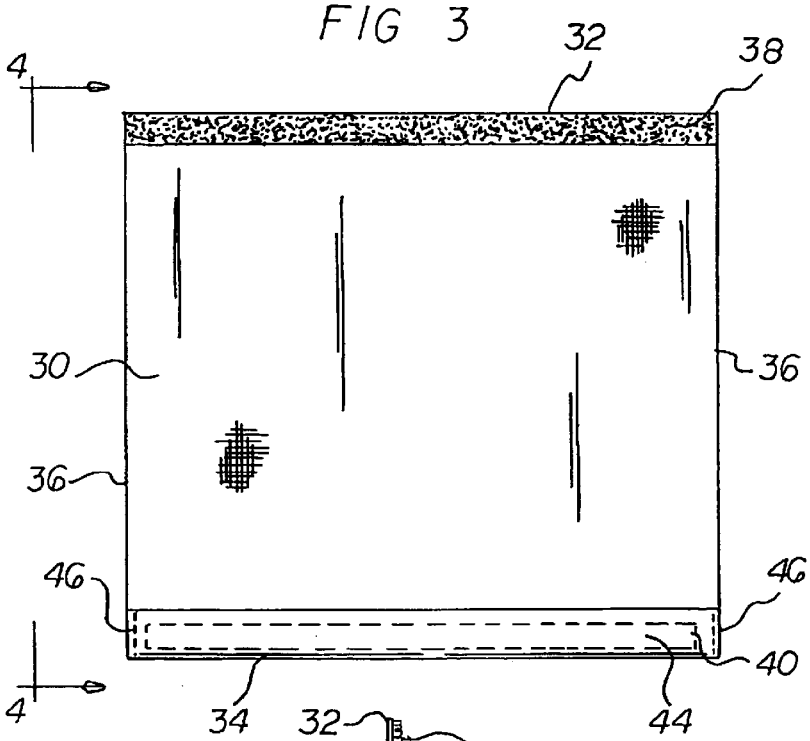
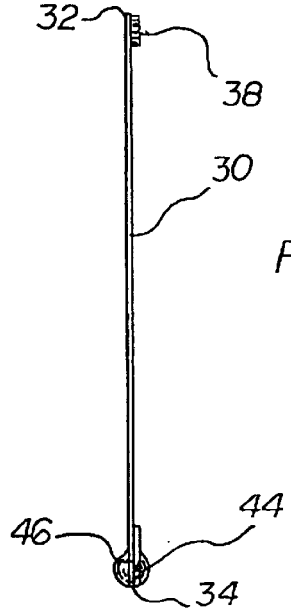
FIG 4

GAS TANK SHADE SYSTEM

BACKGROUND OF THE INVENTION

1. Field of the Invention

The present invention relates to a gas tank shade system and more particularly pertains to minimizing the heating effects of the sun on a tank of gas supporting vessel such as a boat.

2. Description of the Prior Art

The use of protection devices of known designs and configurations is known in the prior art. More specifically, protection devices of known designs and configurations previously devised and utilized for the purpose of protecting watercraft through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,571,722 issued Jun. 3, 2003 to Motsenbocker relates to a computer controlled watercraft. U.S. Pat. No. 6,273,015 issued Aug. 14, 2001 to Motsenbocker relates to a stabilized electric watercraft for high speed cruising, diving and sailing. U.S. Pat. No. 6,230,648 issued May 15, 2001 to Davidson relates to a versatile motor boat. U.S. Pat. No. 5,507,324 issued Aug. 16, 1996 to Whitley relates to fuel fill devices for boats. Lastly, U.S. Pat. No. 5,423,150 issued Jun. 13, 1995 to Hitchcock relates to an automated exterior fire protection system for building structures.

While these devices fulfill their respective, particular objectives and requirements, the aforementioned patents do not describe gas tank shade system that allows minimizing the heating effects of the sun on a tank of gas supporting vessel such as a boat.

In this respect, the gas tank shade system according to the present invention substantially departs from the conventional concepts and designs of the prior art, and in doing so provides an apparatus primarily developed for the purpose of minimizing the heating effects of the sun on a tank of gas supporting vessel such as a boat.

Therefore, it can be appreciated that there exists a continuing need for a new and improved gas tank shade system which can be used for minimizing the heating effects of the sun on a tank of gas supporting vessel such as a boat. In this regard, the present invention substantially fulfills this need.

SUMMARY OF THE INVENTION

In view of the foregoing disadvantages inherent in the known types of protection devices of known designs and configurations now present in the prior art, the present invention provides an improved gas tank shade system. As such, the general purpose of the present invention, which will be described subsequently in greater detail, is to provide a new and improved gas tank shade system and method which has all the advantages of the prior art and none of the disadvantages.

To attain this, the present invention essentially comprises a supporting vessel such as a boat. At the rear end of the boat is a horizontal platform. A vertical rear wall is provided adjacent to the horizontal platform.

A container such as a gas tank is provided. The gas tank is positioned on the horizontal platform adjacent to the vertical rear wall.

Provided next is a first strip of hook and loop fastener. The first strip of hook and loop fastener is secured to the vertical rear wall in a horizontal orientation at an elevation above the container and parallel with the horizontal platform.

Further provided is a shading member. The shading member is fabricated of a flexible material. The shading member is rectangular configuration. The shading member has an upper horizontal edge and a parallel lower horizontal edge. Parallel side edges are provided between the horizontal edges. The shading member has an interior surface. The interior surface has a second strip of a hook and loop fastener. The second strip of hook and loop fastener is adapted to separably coact with the first hook and loop fastener. The first and second hook and loop fasteners are of a common length. The common length is equal to the length of the horizontal edge of the shading member. The lower edge of the shading member has a loop-shaped hem. The side edges of the shading member have a length greater than the hypotenuse of a right triangle formed by the horizontal platform and the vertical rear wall.

Provided last is a weight. The weight is in a cylindrical configuration. The weight is fabricated of a heavy material. The weight is coupled within the hem of the shading member. In this manner the shading member is held in place to shade the container there beneath.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved gas tank shade system which has all of the advantages of the prior art protection devices of known designs and configurations and none of the disadvantages.

It is another object of the present invention to provide a new and improved gas tank shade system which may be easily and efficiently manufactured and marketed.

It is further object of the present invention to provide a new and improved gas tank shade system which is of durable and reliable constructions.

An even further object of the present invention is to provide a new and improved gas tank shade system which is susceptible of a low cost of manufacture with regard to both materials and labor, and which accordingly is then susceptible of low prices of sale to the consuming public, thereby making such gas tank shade system economically available to the buying public.

Even still another object of the present invention is to provide a gas tank shade system for minimizing the heating effects of the sun on a tank of gas supporting vessel such as a boat.

Lastly, it is an object of the present invention to provide a new and improved gas tank shade system. A first strip of a fastener is securable to the vertical rear wall in a horizontal orientation at an elevation above the container and parallel with a horizontal platform. A shading member fabricated of a flexible material is in a rectangular configuration. The shading member has an upper horizontal edge, a parallel lower horizontal edge, and parallel side edges. The shading member has a second strip of a fastener. The second strip of fastener is adapted to separably coact with the first fastener.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which the re is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a front view of the shading member when removed from the supporting vessel.

FIG. 4 is a side elevational view of the shading member taken along line 4—4 of FIG. 3.

The same reference numerals refer to the same parts throughout the various Figures.

DESCRIPTION OF THE PREFERRED EMBODIMENT

Figure 1:
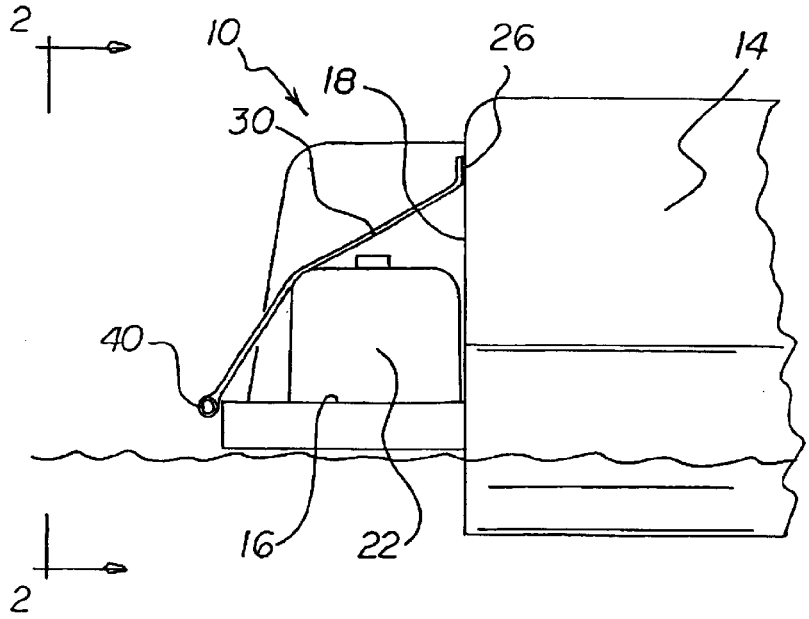
FIG. 1 is a side elevational view of a gas tank shade system constructed in accordance with the principles of the present invention.
Figure 2:
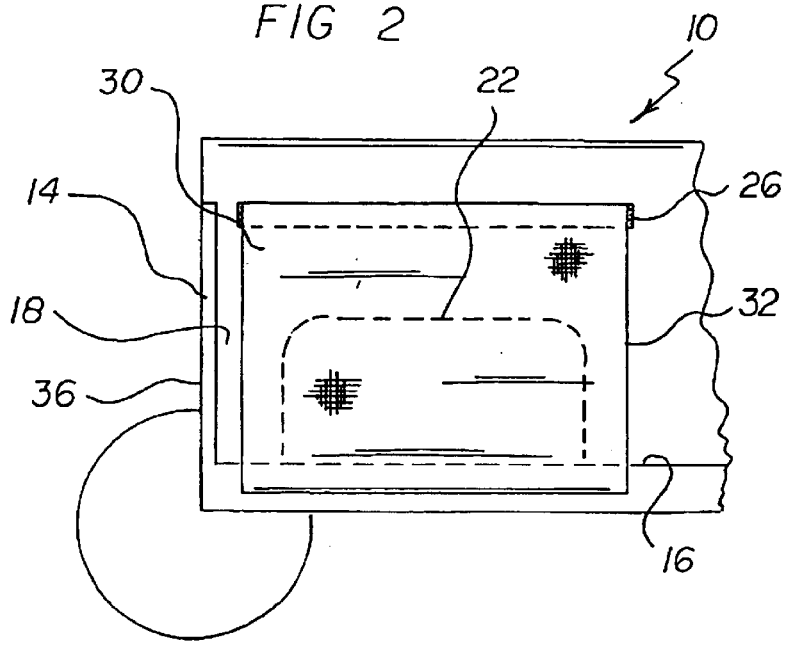
FIG. 2 is a rear elevational view of the system taken along line 2—2 of FIG. 1.

With reference now to the drawings, and in particular to FIG. 1 thereof, the preferred embodiment of the new and improved gas tank shade system embodying the principles and concepts of the present invention and generally designated by the reference numeral 10 will be described.

The present invention, the gas tank shade system 10 is comprised of a plurality of components. Such components in their broadest context include a first strip of a fastener and a shading member. Such components are individually configured and correlated with respect to each other so as to attain the desired objective.

First provided is a supporting vessel 14 such as a boat. At the rear end of the boat is a horizontal platform 16. A vertical rear wall 18 is provided adjacent to the horizontal platform.

A container 22 such as a gas tank is provided. The gas tank is positioned on the horizontal platform adjacent to the vertical rear wall.

Provided next is a first strip 26 of hook and loop fastener. The first strip of hook and loop fastener is secured to the vertical rear wall in a horizontal orientation at an elevation above the container and parallel with the horizontal platform.

Further provided is a shading member 30. The shading member is fabricated of a flexible material. The shading member is in a rectangular configuration. The shading member has an upper horizontal edge 32 and a parallel lower horizontal edge 34. Parallel side edges 36 are provided between the horizontal edges. The shading member has an interior surface. The interior surface has a second strip 38 of a hook and loop fastener. The second strip of hook and loop fastener is adapted to separably coact with the first hook and loop fastener. The first and second hook and loop fasteners are of a common length. The common length is equal to the length of the horizontal edge of the shading member. The lower edge of the shading member has a loop-shaped hem 40. The side edges of the shading member have a length greater than the hypotenuse of a right triangle formed by the horizontal platform and the vertical rear wall.

Provided last is a weight 44. The weight is in a cylindrical configuration. The weight is fabricated of a heavy material. The weight is coupled within the hem of the shading member by closure hems 46. In this manner the shading member is held in place to shade the container there beneath. In an alternate embodiment of the invention, the weight is removably coupled within the hem.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A gas tank shade system for minimizing the heating effects of the sun on a tank of gas supported on a supporting vessel such as a boat comprising, in combination:

a supporting vessel such as a boat with a horizontal platform at the rear end of the boat and a vertical rear wall there adjacent, the horizontal platform having a first width;

a container such as a gas tank positioned on the horizontal platform adjacent to the vertical rear wall;

a first strip of a hook and loop fastener secured to the vertical rear wall in a horizontal orientation at an elevation above the container and parallel with the horizontal platform;

a shading member fabricated of a flexible material, the shading member being imperforate in a rectangular configuration with an upper horizontal edge and a parallel lower horizontal edge and terminating in parallel side edges between the horizontal edges, the shading member having an interior surface with a second strip of a hook and loop fastener adapted to separably coact with the first hook and loop fastener, the first and second hook and loop fasteners being of a common length equal to the length of the horizontal edge of the shading member, the lower edge of the shading member having a loop-shaped hem, the side edges of the shading member having a length greater than the hypotenuse of a right triangle formed by the horizontal platform and the vertical rear wall, the horizontal edges having a second width less than the first width whereby a portion of the horizontal platform may be used as a diving platform while an adjacent portion of the horizontal platform may be used to support a container with the shading member there over; and a weight in a cylindrical configuration fabricated of a heavy material coupled within the hem of the shading member by closure hems to hold the shading member in place to shade the container there beneath whereby the shading member has an intermediate portion in contact with the container and a lower platform in contact with the horizontal portion for accommodating containers of various sizes.

* * * * *